US006478838B2

(12) United States Patent
McSweeney et al.

(10) Patent No.: US 6,478,838 B2
(45) Date of Patent: Nov. 12, 2002

(54) AIRFLOW SYSTEM

(75) Inventors: Anne Margaret McSweeney, Murfreesboro, TN (US); James Jacob Morton, Jr., Eagleville, TN (US); Dan Roger Maxwell, Murfreesboro, TN (US); Guolian Wu, St. Joseph, MI (US); Murray Malone Mallard, Mt. Juliet, TN (US); Christopher Paul Campbell, Nashville, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 3 days.

(21) Appl. No.: 09/757,546

(22) Filed: Jan. 10, 2001

(65) Prior Publication Data

US 2002/0088213 A1 Jul. 11, 2002

(51) Int. Cl.[7] ..... B01D 46/00; H02K 5/24

(52) U.S. Cl. ..... 55/467; 55/385.1; 55/437; 55/447; 55/472; 55/473; 55/482; 96/380; 96/384; 248/603; 248/629; 248/638; 248/674; 310/51; 310/91

(58) Field of Search ..... 55/385.1, 385.2, 55/437, 447, 467, 472, 473, 482, 486, 487; 96/380, 384, 388; 248/603, 604, 629, 638, 674; 310/51, 91; 165/121, 122, 125; 312/31

(56) References Cited

U.S. PATENT DOCUMENTS 2,594,688 A * 4/1952 Shapiro ..... 55/467
3,787,014 A * 1/1974 Story et al. ..... 310/91
3,941,339 A * 3/1976 McCarty ..... 248/603
4,227,101 A * 10/1980 Malakian et al. ..... 310/49 R
4,685,513 A * 8/1987 Longhouse et al. ..... 165/121
5,046,554 A * 9/1991 Iwasaki et al. ..... 165/140
5,141,706 A 8/1992 Clark ..... 422/132
5,435,817 A 7/1995 Davis et al. ..... 55/337
5,492,456 A * 2/1996 Knight et al. ..... 248/604
5,533,704 A * 7/1996 Fischinger et al. ..... 248/603
5,667,564 A 9/1997 Weinberg ..... 96/58
5,749,702 A * 5/1998 Datta et al. ..... 415/119
5,753,000 A 5/1998 Chiu et al. ..... 55/357
6,017,375 A * 1/2000 Duell et al. ..... 55/486
6,028,379 A * 2/2000 Bertolini et al. ..... 310/51
6,036,757 A 3/2000 Gatchell et al. ..... 96/424
6,279,866 B1 * 8/2001 Eilemann et al. ..... 248/638
6,354,380 B1 * 2/2002 Curlee et al. ..... 361/695

* cited by examiner

*Primary Examiner*—Duane Smith
*Assistant Examiner*—Jason M. Greene
(74) *Attorney, Agent, or Firm*—Robert O. Rice; Stephen D. Krefman; Thomas J. Roth

(57) ABSTRACT

An air treatment appliance for treating surrounding air including a body. A spider-mount mounted to the body has a motor mounted thereto in cantilever fashion. A fan attached to the motor may be a radial fan, and is operable to draw in surrounding air and cause it to flow through the appliance. A grommet between the motor and the spider-mount dampens vibrations from the motor. A filtering mechanism in the path of the airflow helps filter out undesirable material from the surrounding air. A radial airflow guide downstream from the fan efficiently guides the airflow to be expelled in a predetermined direction. The motor is at least partially accommodated by the spider-mount and the fan. The apparatus results in reduced noise and vibration during operation of the appliance.

9 Claims, 10 Drawing Sheets

AIRFLOW SYSTEM

BACKGROUND OF THE INVENTION

This invention relates generally to airflow systems and, more particularly, to an improved airflow system and apparatus for an air treatment appliance.

Air purifying devices are known in the art. The devices typically include air purifiers which have an air inlet for air to be drawn into the device, apparatus for drawing in the air, a filtering mechanism to filter out undesirable material from the air drawn in, such as contaminants, dust particles and other debris, and an air outlet for expelling the filtered air. The devices typically also contain other associated components, such as electrical switches and electrical or electronic circuitry for controlling and monitoring the operation of the device. During operation, the apparatus for drawing in the air typically operates to create airflow through the device and through the filtering mechanism to filter out undesirable material from the surrounding air. In this regard, the apparatus typically includes a rotatable fan and an associated motor to create the desired airflow. The fan and associated motor are typically rigidly mounted to the frame or body of the device in a conventional manner, such as by screws or by bolts.

The fan and the associated motor usually include moving parts that generate noise and vibration. A fan and associated motor operating at a typical speed usually generate noise and vibration at a frequency that can be heard and/or sensed by a person in the vicinity of the appliance. Such noise and vibration are communicated to the body or frame of the device because the fan and the motor are rigidly mounted thereto, and the noise and vibration are then emitted from the body or frame of the device. Such noise and vibration, however, are undesirable in the device, particularly when the device is used in a relatively quiet environment such as a home or an office.

The fan and associated motor in known air treatment appliances are usually not ideally energy-efficient. This is typically because of the design and construction of the fan and the airflow system, and the pressure drop created at the filter mechanism in the path of the airflow. Other appliances include an ordinary-type fan that draws air straight through, and the air is deflected from a shield or other deflector means in order to be expelled from the device in a particular direction. Besides being inefficient, such design and construction usually also contributes to undesirable noise and vibration generated by the airflow through the appliance. Further yet, such design and construction results in an increased size of the overall device, which is usually an undesirable characteristic in such devices. It is typically preferable to minimize the size of such devices for the convenience of users, whereby it is important to optimize the size and dimensions of the overall device.

Other appliances, particularly air treatment appliances such as air conditioners, humidifiers, dehumidifiers, and the like, have similar constructions as those of air purifiers, and therefore suffer from similar or substantially the same drawbacks.

There is, therefore, a need for an improved air purifying device or other appliance wherein the airflow system is designed and constructed to minimize the amount of noise and vibration generated by the device while the energy efficiency of the device is improved and the size of the device is optimized. Accordingly, this invention is directed to overcoming one or more of the problems set forth above.

SUMMARY OF THE INVENTION

In an embodiment, the invention is suitable in an air treatment appliance for treating surrounding air, including a body and a spider-mount mounted to the body. A motor is mounted to the spider-mount in cantilever fashion. A fan attached to the motor may be a radial fan, and is operable to draw in surrounding air and cause it to flow through the appliance. A grommet between the motor and the spider-mount dampens vibrations from the motor, and assists in easier construction of the device and improved product integrity during shipping. A filtering mechanism in the appliance in the path of the airflow filters out undesirable material from the air. A radial airflow guide guides the airflow downstream from the fan. The motor may be accommodated at least partially in the spider-mount and the fan. In combination, the apparatus provides improved noise and vibration characteristics and better efficiency during operation of the device.

DETAILED DESCRIPTION OF THE INVENTION

The present invention is useful in a wide variety of appliances, particularly air treatment appliances with internal components such as a means for moving air through the appliance. One such appliance in which the invention finds utility is an air purifying device. It is this appliance in which the invention will be described, although it should be understood that the invention is not limited to this particular appliance.

Figure 1:
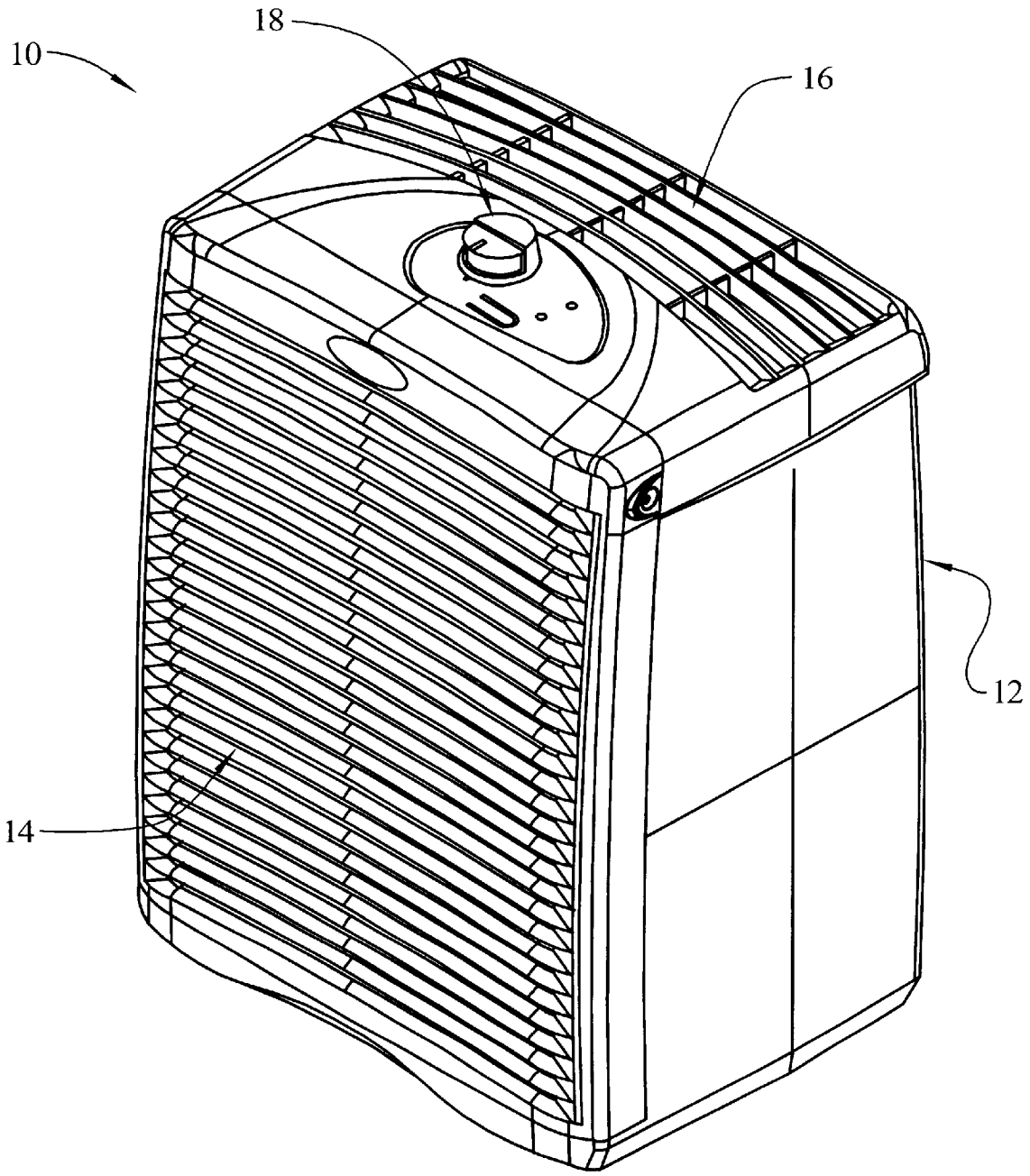
FIG. 1 is a front perspective view of the exterior of an air purifying device according to one embodiment of the present invention.

Referring to FIG. 1, the exterior of an air purifying device 10 with its body in a closed position according to one embodiment of the present invention is shown. The device 10 includes an exterior body 12 which houses the internal components of the device 10. The body 12 will usually be comprised of two or more portions operatively connected together, which portions may be disconnected from each other at least partially, or even removed altogether, to provide access to the interior of the device. The body 12 will typically also include other functional features such as an air inlet 14 and an air outlet 16 to allow airflow through the device 10.

The device 10 also includes an electrical control means 18, such as an electrical switch, a control knob, or the like, for at least partially controlling the operation of the device. It is recognized and anticipated that any electrical or electronic control apparatus known in the art that is usable with air treatment appliances may be used in the device 10 as electrical control means 18. In other embodiments, it is recognized that the electrical control means 18 may be eliminated altogether. However, it is anticipated that the electrical control means 18 will typically include at least a power switch for switching the device 10 on or off. The electrical control means 18 may also include additional components such as a user selectable speed control mechanism for selectively controlling the speed of operation of the device 10, a corresponding visual indicator such as a light or an LED indicative of the selected speed of operation, and the like. Accordingly, all such variations and embodiments of the electrical control means 18 are recognized and anticipated, and therefore it is intended that the claims shall cover all such embodiments that do not depart from the spirit and scope of the present invention.

The air inlet means 14 typically provides an inlet for the surrounding air to be drawn into the air purifying device 10. In this regard, the air inlet means 14 will provide an opening in the body 12. Typically, the air inlet means 14 will include louvers with openings inbetween of a predetermined width. The louvers serve to prevent any large objects from being undesirably drawn into the device 10 along with the air being drawn in, which may damage the device or inflict injury upon a person or a pet, etc., in the vicinity of the device. In one embodiment, the louvers further serve to draw in air in a direction away from the air outlet means 16 in order to prevent direct recirculation of air already treated and expelled by the device 10. In other embodiments, the device 10 may have a wire mesh or wider-sectioned openings instead of louvers to serve as the air inlet means 14. The air inlet means 14 may also comprise a series of spaced openings through an otherwise planar or curved surface of the body 12. Accordingly, all such variations and embodiments are recognized and anticipated. It is, however, preferable that the air inlet means 14 be designed to minimize cross-sectional exposure to the airflow therethrough in order to achieve improved performance efficiency from the device 10, and for minimizing noise generated by the airflow through the air inlet means 14 during operation of the device 10. In this regard, irrespective of whether the air inlet means 14 includes louvers, wire mesh or openings, it is recognized that the shape and construction thereof facing the direction of the airflow may be designed to facilitate smoother transition of airflow therethrough, such as by having a narrower leading edge on relatively flat louvers. This will serve to provide a quieter operation of the device 10.

Similarly, the body 10 includes an air outlet means 16 for expelling the air that is drawn into the device through the air inlet means 14, whereby the air outlet means 16 will also provide an opening in the body 12. In this regard, the air outlet means 16 will typically be spaced apart from the air inlet means 14. Typically, the air outlet means 16 will also include louvers with openings inbetween of a predetermined width. In other embodiments, however, the device 10 may have a wire mesh or wider-sectioned openings to serve as the air outlet means 16. The air outlet means 16 may also comprise a series of spaced openings through an otherwise planar or curved surface of the body 12. Accordingly, all such embodiments are recognized and anticipated. It is, however, preferable that the air outlet means 16 also be designed to minimize cross-sectional exposure to the airflow therethrough in order to achieve improved performance efficiency from the device 10 and for minimizing noise generated by the airflow through the air outlet means 14 during operation. In this regard, irrespective of whether the air outlet means 16 includes louvers, wire mesh or openings, it is recognized that the shape and construction thereof facing the direction of the airflow may be designed to facilitate smoother transition of airflow therethrough, such as by having a narrower leading edge on relatively flat louvers. This will likewise serve to provide a quieter operation of the device 10.

The construction of the air outlet means 16 in a particular embodiment of the device 10 does not have to identically match the construction of the air inlet means 14 in that same embodiment. The construction of each of the air inlet means 14 and the air outlet means 16 may be similar or they may be different, and it is recognized that the construction thereof will typically vary from one embodiment to another.

Figure 2:
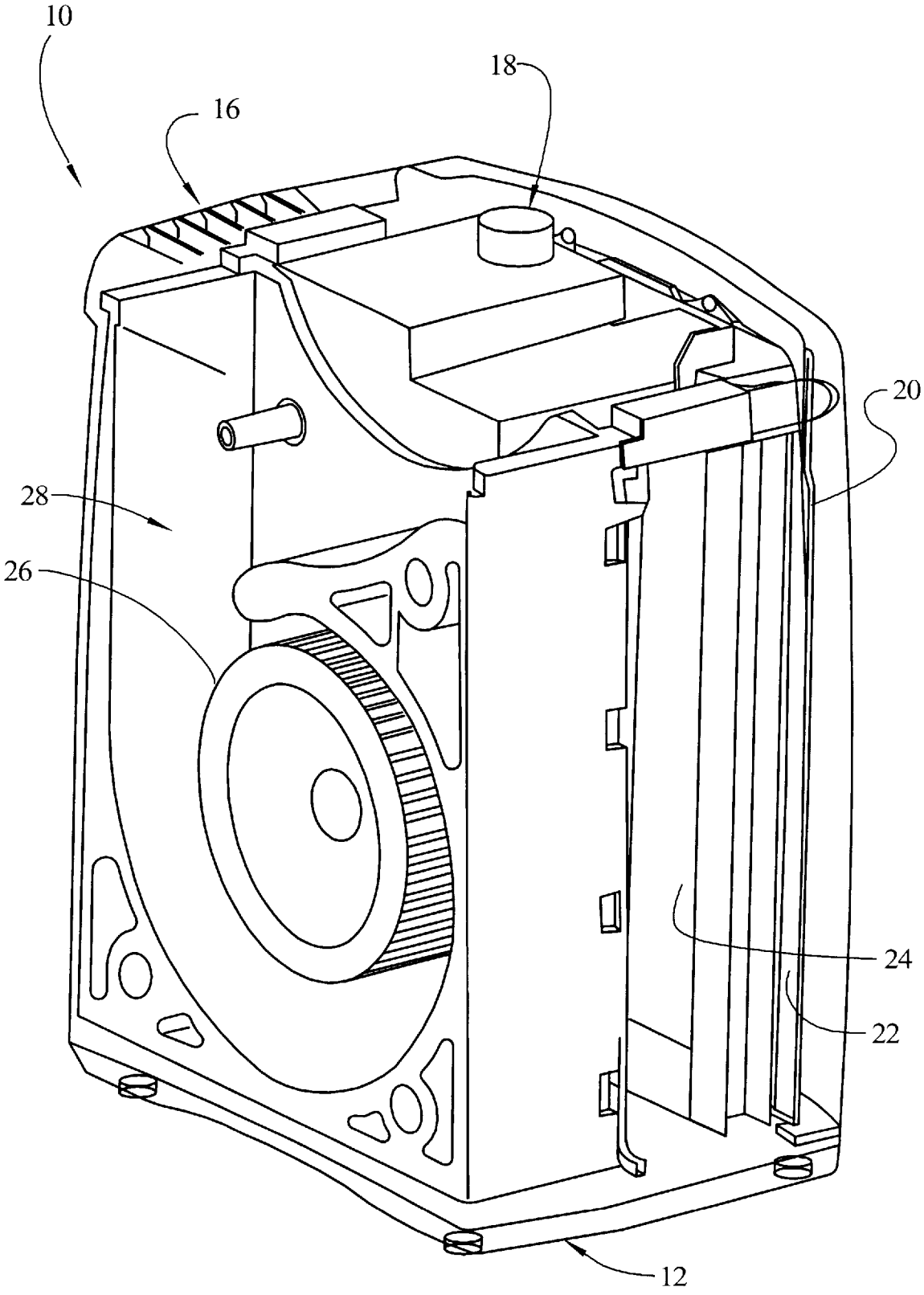
FIG. 2 is a rear perspective partially cut-away view of the air purifying device of FIG. 1, wherein the components within the device are partially visible.

Referring to FIG. 2, a rear perspective view of the air purifying device of FIG. 1, wherein the components within the device are partially visible, is shown. Some components of the device 10 in the interior of the body 12 are partially visible from the exterior of the device 10, thereby illustrating the internal design and construction of the respective portion of the device 10. More particularly, a filtering mechanism 20 is shown at the front of device 10. Those skilled in the art will appreciate that airflow through the device 10 will pass through the filtering mechanism 20, whereby undesirable material in the air may be filtered out. In one embodiment, the filtering mechanism 20 includes a pre-filter 22 and a HEPA filter 24. A fan 26 is also visible in FIG. 2, the implementation and functioning of which is discussed in more detail below. An airflow guide 28 for guiding the airflow of the air emitted by the device 10 is also shown, the implementation and functioning of which is also discussed in more detail below.

Figure 3:
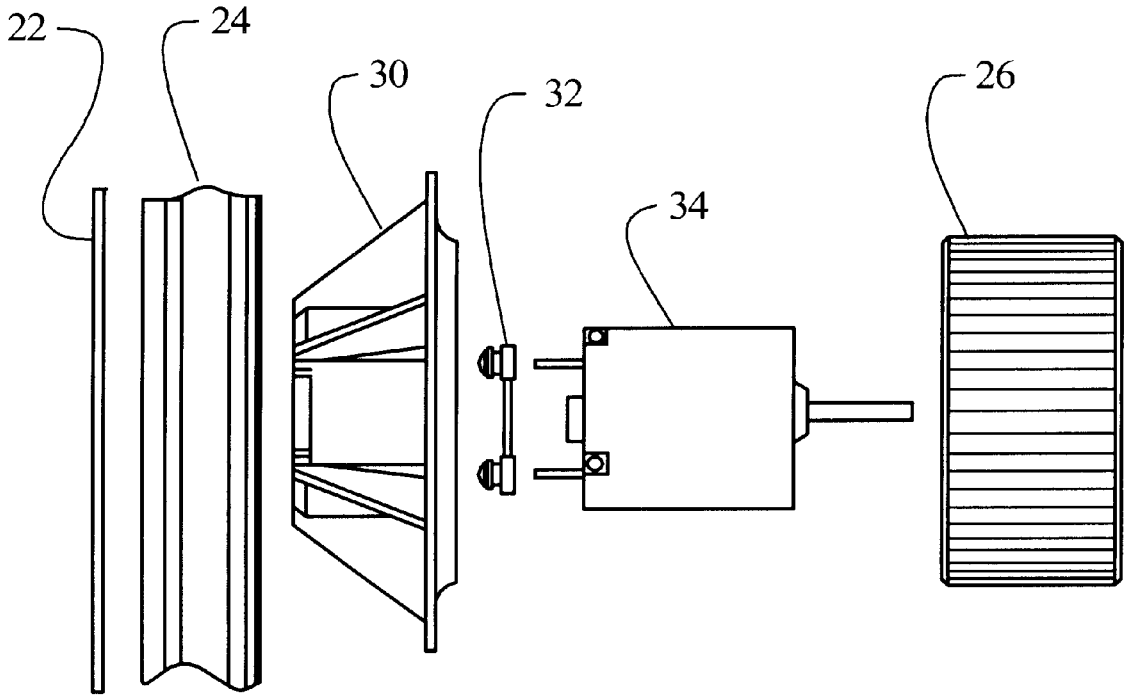
FIG. 3 is an exploded view of an airflow system apparatus according to one embodiment of the present invention.

Referring to FIG. 3, an exploded view of an airflow system apparatus in the device 10 according to one embodiment of the present invention is shown. More particularly, FIG. 3 illustrates the positioning of the various parts of the airflow apparatus in the device 10 with respect to each other. The pre-filter 22 and the HEPA filter 24 are positioned before a spider-mount 30. A grommet 32 is positioned between a motor 34 and the spider-mount 30. A fan 26 is connected to the motor 34 at an opposite end from the spider-mount 30. In this configuration, the fan 26 is operable to draw in air through the pre-filter 22 and the HEPA filter 24, through the spider-mount 30, around the motor 34, and past the fan 26. Airflow past the fan 26 is discussed in more detail below.

Figure 4:
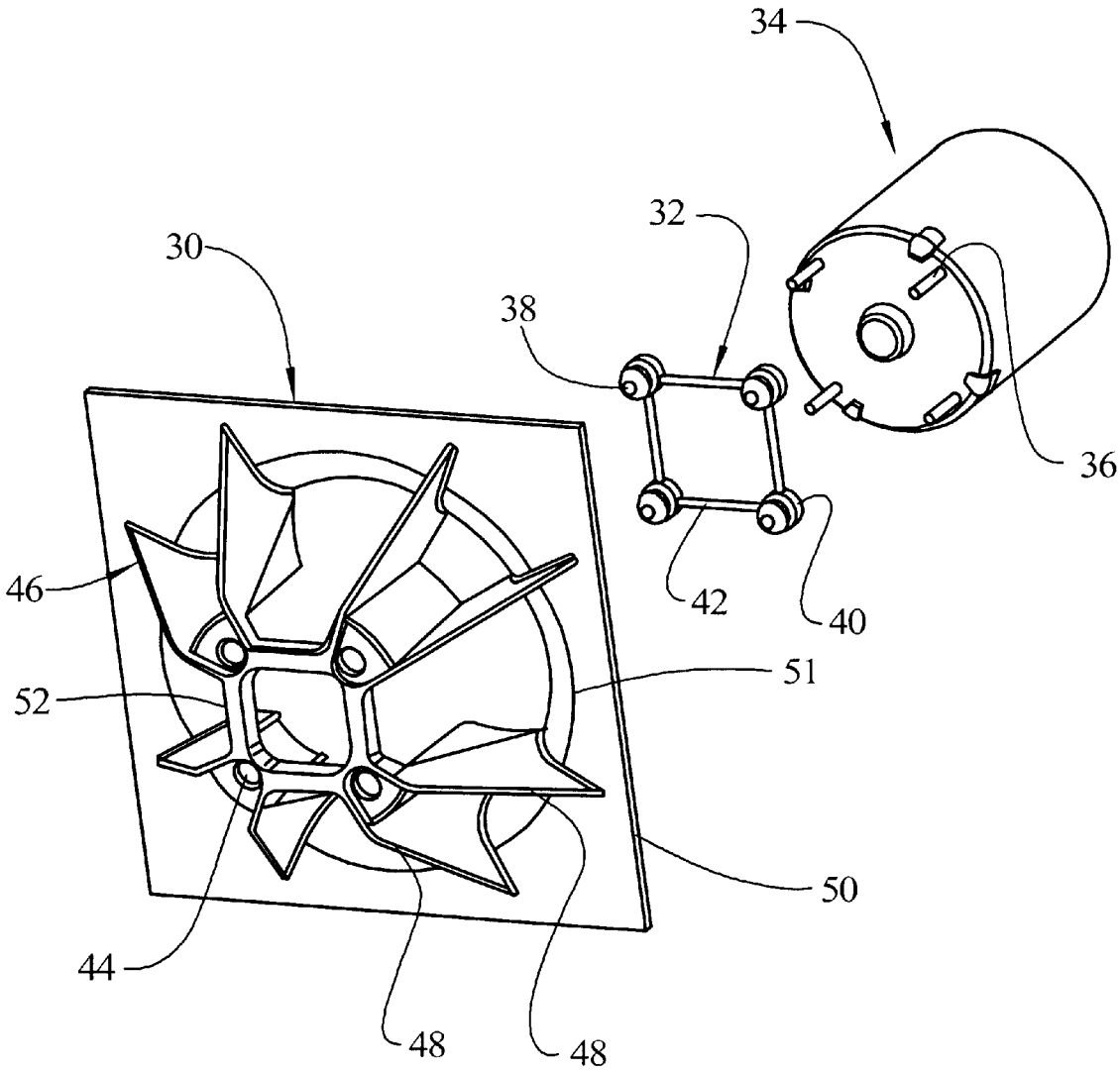
FIG. 4 is an elevated perspective exploded view of a portion of the apparatus of FIG. 3.

Referring to FIG. 4, an elevated perspective exploded view of some of the apparatus of FIG. 3 is shown. More particularly, the spider-mount 30, the grommet 32 and the motor 34 are shown in an exploded view with their positioning with respect to each other. The motor 34 is attachable to the spider-mount 30, with the grommet 32 positionable between them. More particularly, screws 36 on the motor 34 pass through holes 38 in feet 40 of the grommet 32. The feet 40 of the grommet 32 are connected together by connection members 42. In the embodiment depicted in FIG. 4, there are four screws 36 on the motor 34, and there are four feet 40 in the grommet 32, each foot 40 having a hole 38, corresponding to each of the four screws 36. In other embodiments, however, it is recognized that the number of screws 36 and feet 40 may be varied in order to accommodate the particular design specifications of the particular embodiment. For example, in an embodiment of a larger implementation of the motor 34, it may be desirable to have a greater number of screws 36 for more securely holding the motor 34 with respect to the spider-mount 30. Accordingly, all such embodiments are recognized and anticipated.

The screws 36 also pass through corresponding holes 44 in the spider-mount 30. In one embodiment, the spider-mount 30 includes four fins 46, with each fin 46 having two leaves 48 and one hole 44. The fins 46 are connected to a plate 50 at one end, and to each other via bars 52 at the other end. Accordingly, it may be appreciated that the holes 44 in the fins 46 and the bars 52 will be at least some distance from the plate 50.

The plate 50 has an additional feature in one embodiment of the present invention. A curved surface 51 in the plate 50 is designed to provide a comparatively smooth transition of airflow through the spider-mount 30 to the fan 26 during operation of the device 10. The curvature and precise shape of the curved surface 51 can be determined based on the particulars of a particular embodiment, but it is recognized and anticipated that the purpose thereof will be to assist in providing improved airflow characteristics through the plate 50 while minimizing sound produced by the airflow therethrough during operation of the device 10. As shown in FIG. 4, the fins 46 and the leaves 48 follow the curved surface 51, whereby the cross-sectional exposure thereof to the airflow remains substantially consistent without any abrupt terminations or edges in the path of the airflow. Those skilled in the art will appreciate that this apparatus contributes towards a quieter performance of the device 10 during operation.

Figure 5:
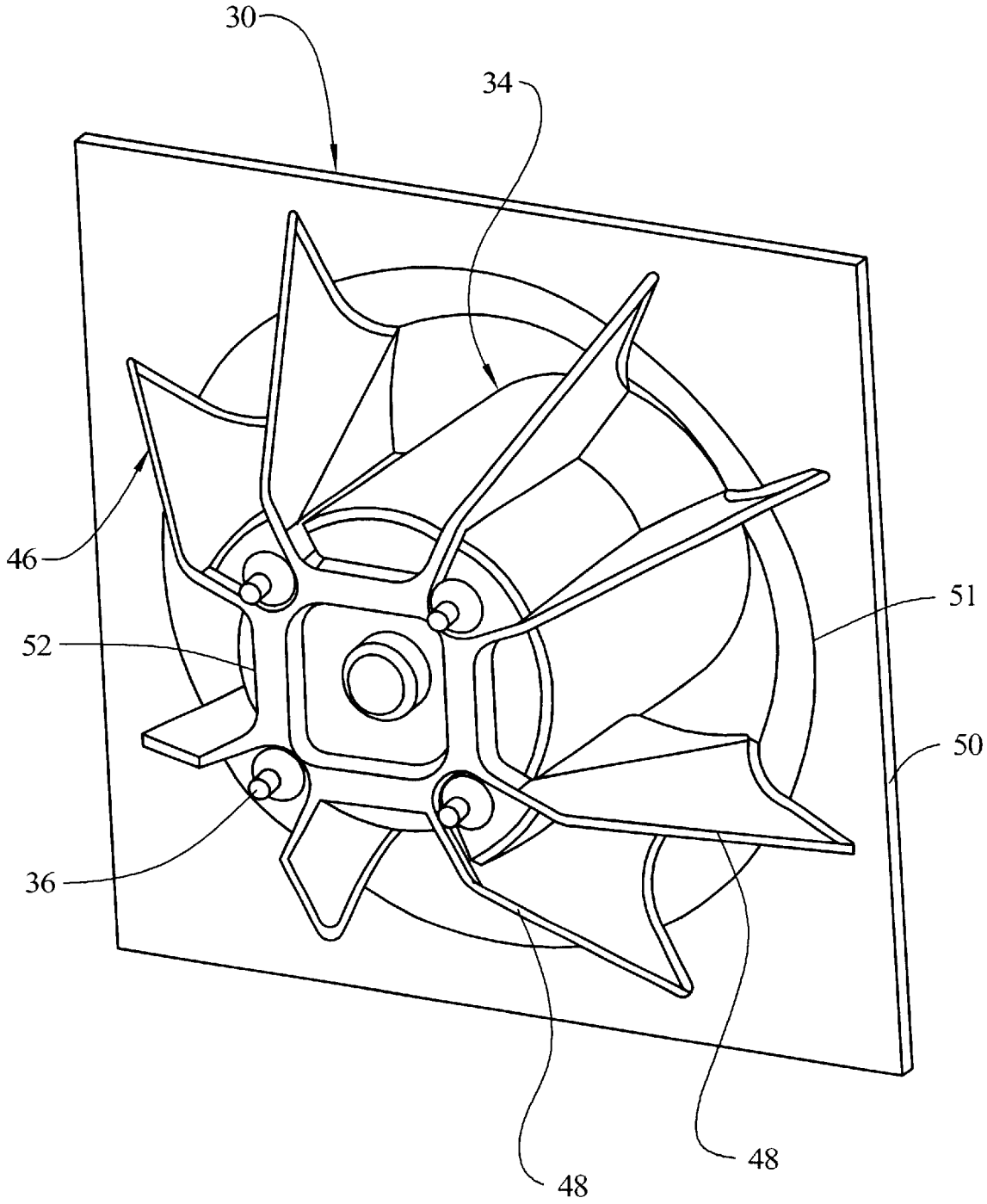
FIG. 5 is a rear elevated view of a motor mounted to a spider-mount in cantilever fashion in the apparatus of FIG. 3.

Referring to FIG. 5, a rear elevated view of the motor 34 mounted to the spider-mount 30 in cantilever fashion is shown. The grommet 32 is not shown in this embodiment to illustrate that the grommet 32 can be eliminated in alternate embodiments of the present invention. Because the grommet 32 serves some desirable functions as discussed in more detail below, however, it is preferable to include the grommet 32 in the apparatus of the present invention. As shown in FIG. 5, when the motor 34 is mounted to the spider-mount 30, the motor 34 is held in a cantilever fashion to the spider-mount 30. The only connection that the motor 34 has with the spider-mount 30 is via the screws 36 at one end of the motor 34. The opposite end of the motor 34 is suspended freely in a cantilever fashion. As discussed below, this feature provides important benefits in minimizing sound and vibrations during operation of the present invention.

Figure 6:
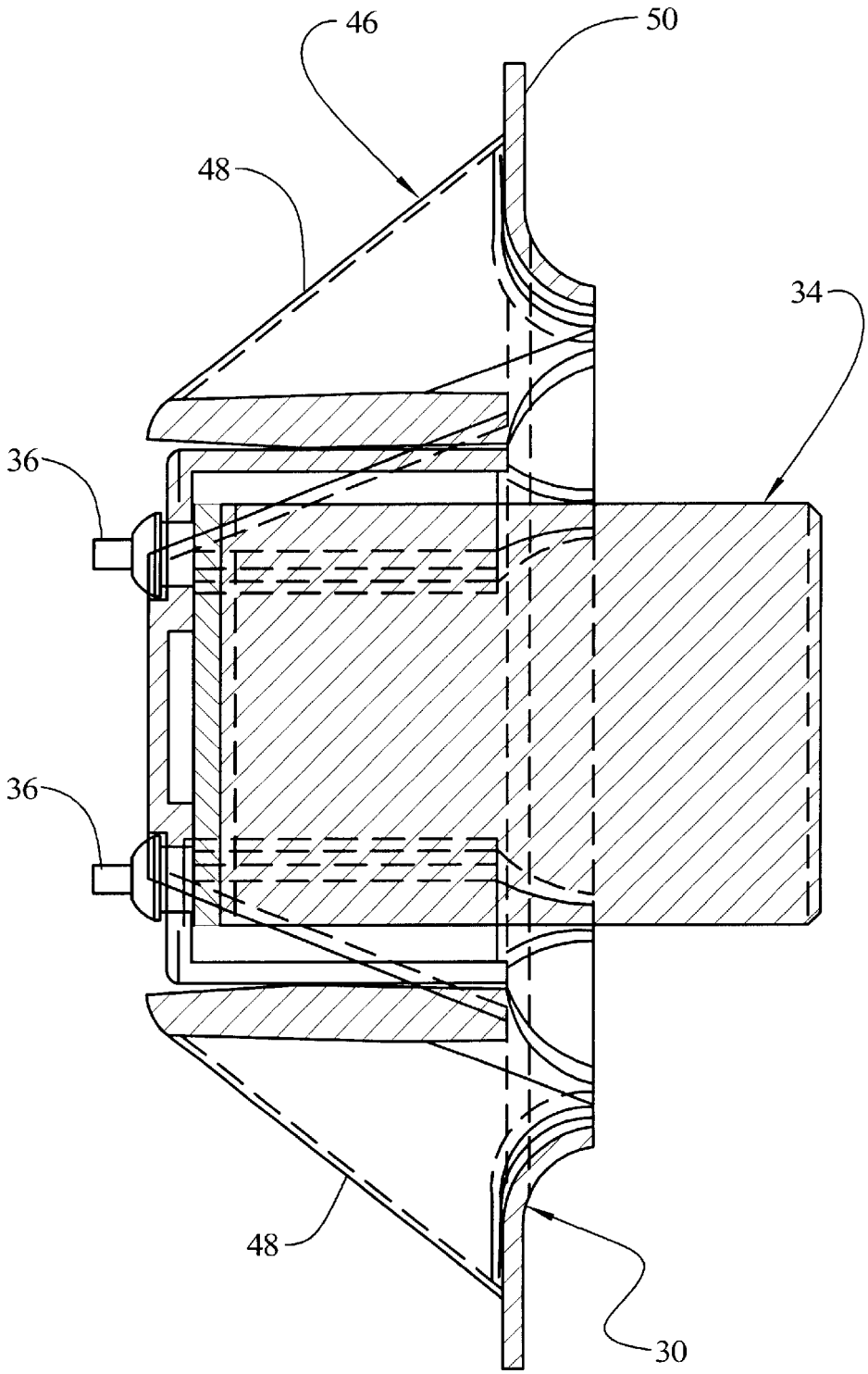
FIG. 6 is a partially cut-out side view of the motor mounted in cantilever fashion to the spider-mount of FIG. 5.

Referring to FIG. 6, a partially cut-out side view of the motor 34 mounted to the spider-mount 30 of FIG. 5 is shown. As shown, the motor 34 is mounted in a cantilever fashion with only the screws 36 on one end coming into contact with the spider-mount 30. Further in FIG. 6, it can be seen that a considerable portion of the motor 34 is accommodated in the spider-mount 30, which helps reduce the overall size of the device 10.

Mounting the motor 34 in cantilever fashion to the spider-mount 30 serves an additional benefit during shipping and handling of the device 10. The cantilever mount improves product integrity during shipping and handling by effectively reducing stress and cracks from occurring or propagating in the spider-mount 30 due to the weight of the motor 34 during shipping and handling of the device 10. Such improved product integrity contributes towards lowering the costs of producing and marketing the end product.

Figure 7:
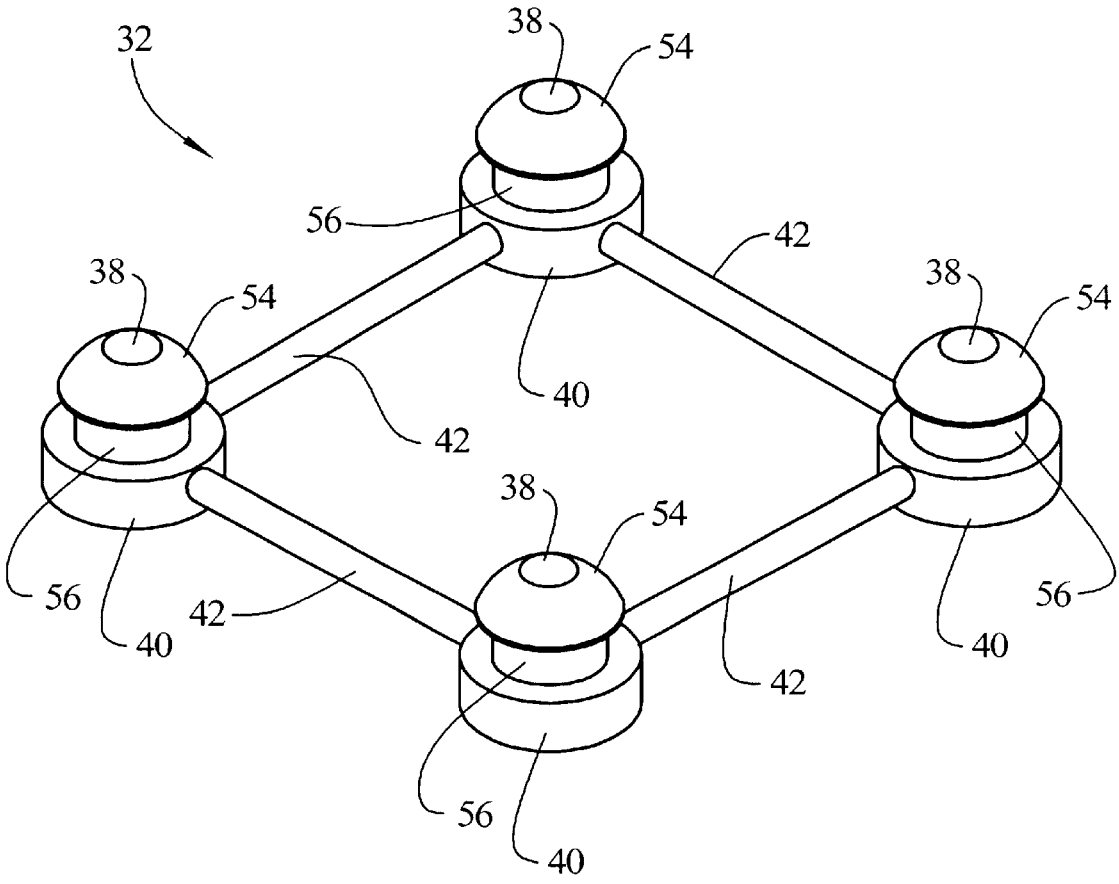
FIG. 7 is an elevated perspective view of a grommet in the apparatus of FIG. 3.

Referring to FIG. 7, an elevated perspective view of the grommet 32 is shown. In one embodiment, the grommet 32 includes four feet 40 connected together by four connection members 42, with a hole 38 in each foot 40. In one embodiment the grommet 32 is constructed as one integral piece, although it is recognized and anticipated that the grommet 32 may be constructed by assembling together different individual pieces, such as the feet 40 and the connection members 42. It is, however, preferable that the grommet 32 be constructed as one integral piece for durability, economical production, product life, and product integrity.

One of the more significant purposes of the grommet 32 in the present invention is to dampen vibrations and noise generated by the motor 34 and the fan 26. In this regard, the durometer and material of the grommet 32 is important. Accordingly, the material, including the durometer thereof, can be selected according to the particular embodiment of the present invention. This will typically depend upon the frequency of the vibrations generated by the motor 34, the weight of the motor 34, the speed of operation of the fan 26, and the like. The material of the grommet 32 will therefore have some inherent flexibility, and is rubber or plastic in some embodiments of the present invention. Experiments have shown that it is desirable that the material of the grommet 32 be particularly effective for dampening vibrations at approximately twice the frequency of the AC power supplied to the motor 34. Accordingly, it is desirable that the material be operable to dampen frequencies of 120 Hertz for operation in countries that have electrical power at 60 Hertz, such as the United States of America, and approximately 100 Hertz for operation in certain other countries that have electrical power at 50 Hertz, such as the United Kingdom. Those skilled in the art will appreciate that by selecting an appropriate material for the grommet 32 will contribute to quieter performance of the device 10 during operation. In this regard, those skilled in the art will appreciate that the grommet 32 will help minimize both sound and vibrations during operation of the device 10.

The grommet 32 in the present invention is also designed to have additional beneficial features. Each foot 40 includes a head 54 and a neck 56. During production, each head 54 is designed to be inserted through a respective hole 44 in the spider-mount 30. The head 54 has a mushroom shape with a predetermined curvature, or lead-in angle, at its front end, which facilitates the process of inserting the head 54 through the hole 44. Further, given the inherently flexible characteristics of the material of the grommet 32, the head may be comparatively easily squeezed through the corresponding hole 44 during production of a device 10 according to the teachings of the present invention. When the head is inserted into its corresponding hole 44, and pushed past the hole 44, the neck 56 behind the head 54 enters and covers the hole 44. In such position with the neck 56 in the hole 44, the foot 40 is held in such substantially locked position with respect to the hole 44. Similarly, each of the remaining feet 40 can be positioned in their respective holes 44 in a substantially locked position. Given the construction of the grommet 32 mated to the position of the holes 44 in the spider-mount 30, all feet 40 in the grommet 32 should fall into place, whereby each head 54 can be inserted, or pushed, into its respective hole 44. Those skilled in the art will appreciate that this feature of the present invention facilitates the production of the device 10, thereby contributing to lower production costs of the device 10. Further, with each foot 40 snapped into place with its respective hole 44, the grommet 32 is held substantially fixedly with respect to the spider-mount 30, which also contributes to easier and more expedient manufacturing of the device 10.

Because each hole 44 is completely covered by the material of the grommet 32, the screws 36 do not come in direct contact with the spider-mount 30. Accordingly, there is no direct physical contact between the motor 34 and the spider-mount 30. Therefore, any vibrations produced by the motor 34, and the fan 26 attached thereto, during operation of the device 10 are dampened by the grommet 32 prior to being communicated to the spider-mount 30. As discussed above, the material of the grommet 32 is preferably designed to dampen vibrations and sound generated by the motor 34 and the fan 26 during operation of the device 10. Further, those skilled in the art will appreciate that the cantilever mounting of the motor 34 will also serve to dissipate vibrations produced by the motor 34 and fan 26 during operation. The construction and implementation of the cantilever mounting of the motor 34 can be designed accordingly, whereby the cantilever suspension of the motor 34 will dissipate an optimal amount of vibrations during operation of the device 10. Therefore, in combination, the apparatus of the present invention, including the grommet 32 and the cantilever mounted motor 34, serves to considerably lessen vibration during operation of the device 10.

Figure 8:
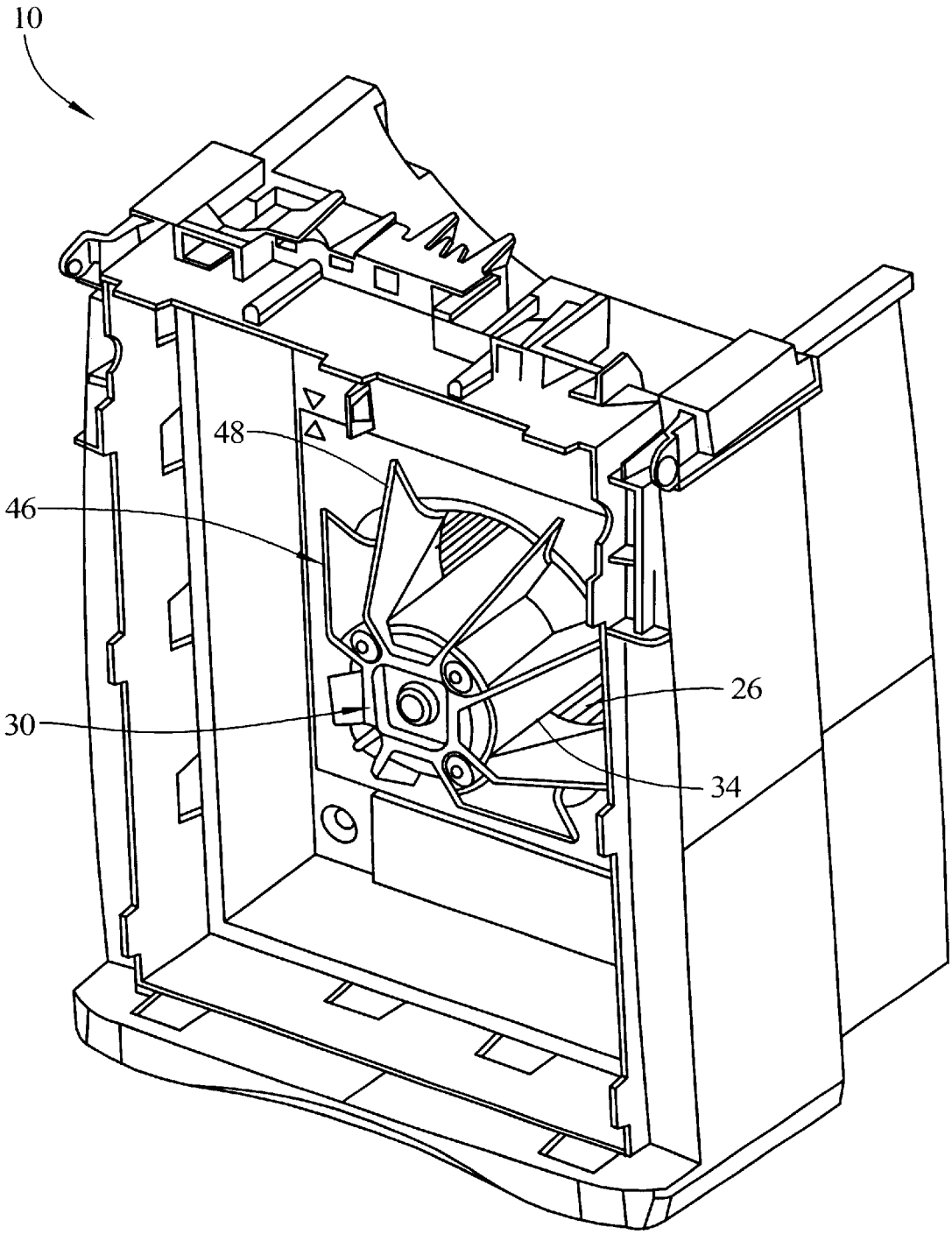
FIG. 8 is an elevated front cut-away perspective view of a portion of the device of FIG. 1.

Referring to FIG. 8, an elevated front cut-away perspective view of a portion of the device of FIG. 1 is shown, including the spider-mount 30 and its placement in the device 10 according to one embodiment of the present invention. The motor 34 positioned in the spider-mount 30 is also shown. Those skilled in the art will appreciate that surrounding air will be drawn into the device 10 by the fan 26 through the filtering mechanism 20 (not shown in FIG. 8) into the front area that is shown in FIG. 8. The fan 26, only a portion of which can be seen in FIG. 8, is a radial fan which draws air in the middle and expels it radially. From the front area in the device 10, the surrounding air drawn in flows through the spider-mount 30, around the motor 34, to the fan 26. The air flowing through the spider-mount 30 around the motor 34 encounters the narrow edges of the leaves 48 in the fins 46 of the spider-mount 30. A substantial portion of the bodies of the leaves 48 in the fins 46 do not pose any resistance to the airflow because they lie in parallel with the direction of the airflow, and therefore their cross-sectional exposure to the airflow is minimal. It will be appreciated that this design feature results in a minimized resistance to the airflow through the spider-mount 30 due to the minimized cross-sectional exposure to the airflow, thereby improving the energy-efficiency and airflow of the device 10. Further, such minimized cross-sectional exposure to the airflow improves the sound quality of the device 10 by minimizing sound generated due to obstructions in the path of the airflow through the device 10. Accordingly, such design and construction contributes to quieter performance of the device 10 during operation.

As shown in the figures, the spider-mount 30 has four fins 46, with each fin 46 having two leaves 48 each. However, it is recognized that the number of fins 46 and the corresponding number of leaves 48 therein will vary according to the particular embodiment of the present invention. It is recognized that this will typically depend upon the dimensions and weight of the motor 34, and the strength of the material comprising the fins 46 in the spider-mount 30.

Figure 9:
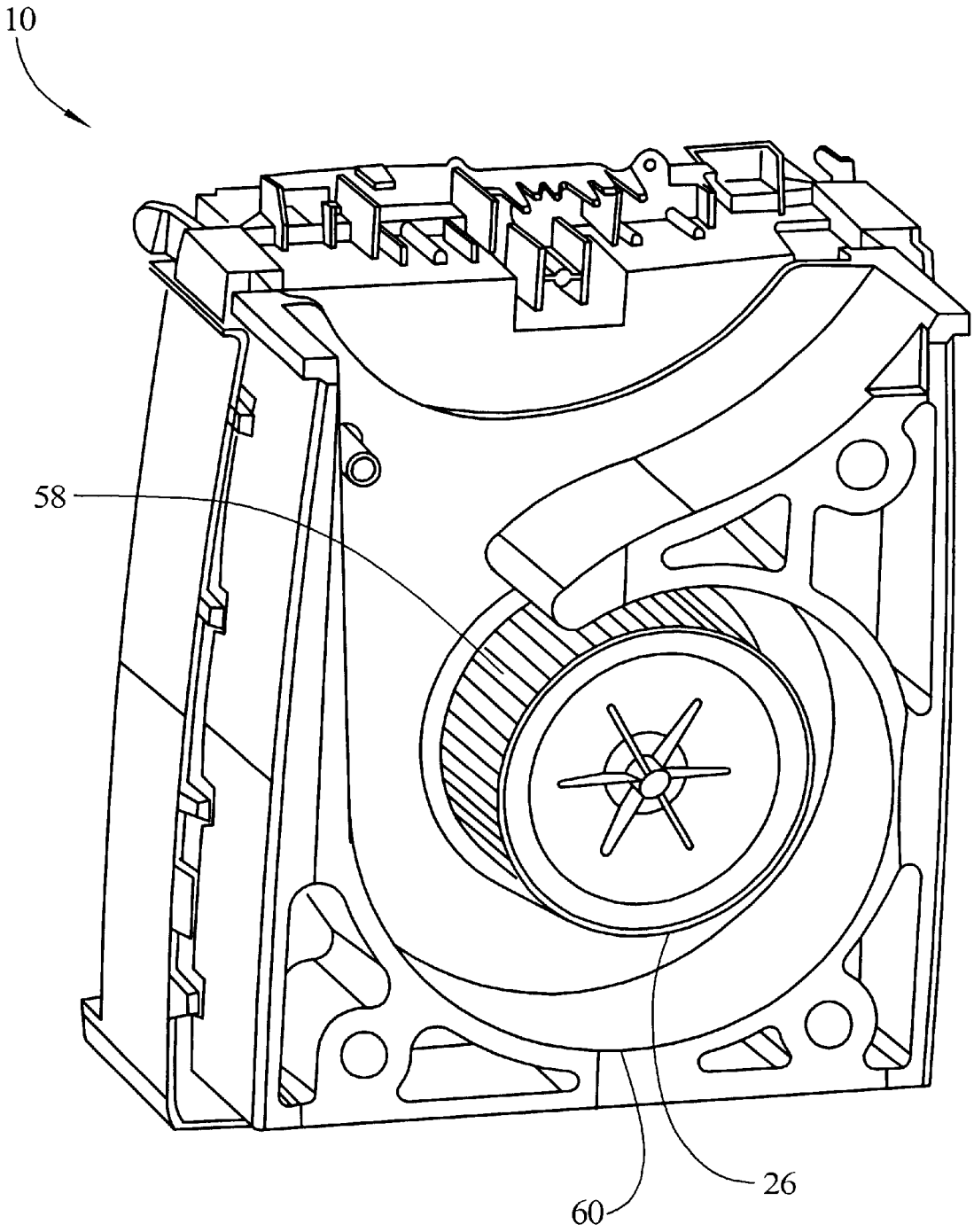
FIG. 9 is a rear cut-away perspective view of a portion of the device of FIG. 1.

Referring to FIG. 9, a rear cut-away perspective view of a portion of the device of FIG. 1 is shown. The fan 26, which is a radial fan in the embodiment depicted, draws in surrounding air through the filtering mechanism 20 and the front portion of the device 10, and expels it radially in the rear portion of the device 10 which is depicted in FIG. 9. The radial fan has a plurality of blades 58 that are designed to expel air radially in a predetermined radial direction. It is recognized and anticipated that the number of blades 58 and the angles thereof shall typically vary according to the particular embodiment of the present invention. It is recognized that this will typically depend on the speed of the motor 34, the power of the motor 34, the size of the fan 26, the amount of airflow desired through the device 10, and the like. Accordingly, all such embodiments are recognized and anticipated.

Those skilled in the art will appreciate an additional benefit derived from having a radial fan 26 in the present invention. As discussed above, a portion of the motor 34 is accommodated in the spider-mount 30. A considerable portion of the remainder of the motor 34 is preferably accommodated in the radial fan 26. This results in a more compact construction of the device 10, thereby reducing the overall size of the device 10. It is anticipated that a different type of fan, such as an ordinary straight airflow fan, may be used instead of a radial fan in alternate embodiments of the present invention. In such embodiments, it is recognized that the fan blades may also be designed to accommodate a portion of the motor 34, whereby the size and construction of the device 10 may be kept compact as discussed above. However, a radial fan is preferable in the embodiment of the device 10 shown in the figures because of at least two important reasons. The first reason is that the downstream airflow travels radially (which is discussed in more detail below), whereby delivering the air downstream in a radial manner improves the efficiency of the device 10. The second reason is that the radial downstream expulsion of airflow from the fan 26, which is mated with the radial flow of air through an airflow guide 60 downstream from the fan 26, helps minimize sound generated by the airflow through the device 10 during operation of the device 10. This is typically because obstructions or resistance to the airflow through the device 10 at the fan 26 are minimized because the airflow does not have to be deflected or reflected, and the radial expulsion of air from the fan 26 naturally cooperates with the subsequent radial path of the airflow through the airflow guide 60 downstream from the fan 26. Accordingly, the apparatus of the present invention provides for a quieter performance of the device 10 during operation.

The air expelled radially downstream by the fan 26 is guided by the airflow guide 60 in one embodiment of the present invention. The purpose of the airflow guide 60 is to guide the airflow downstream from the fan 26 through the device 10 before it is expelled from the device 10 in a predetermined manner or direction. In the embodiment depicted in FIGS. 9 and 10, the airflow guide 60 is a radial guide which expands radially in a clockwise direction, terminating towards a top portion of the device 10. Accordingly, the airflow through the device 10 is expelled at the top of the device 10 in the embodiment depicted. However, it is recognized and anticipated that in other embodiments, the airflow guide 60 may be designed to terminate at a different portion of the device 10 in order to expel the airflow from the device 10 in a different direction. In all such embodiments, however, it is preferred that the airflow guide 60 and the direction of the airflow therethrough be designed to cooperate with the downstream airflow from the fan 26 in order to minimize the noise generated during operation of the device 10.

Figure 10:
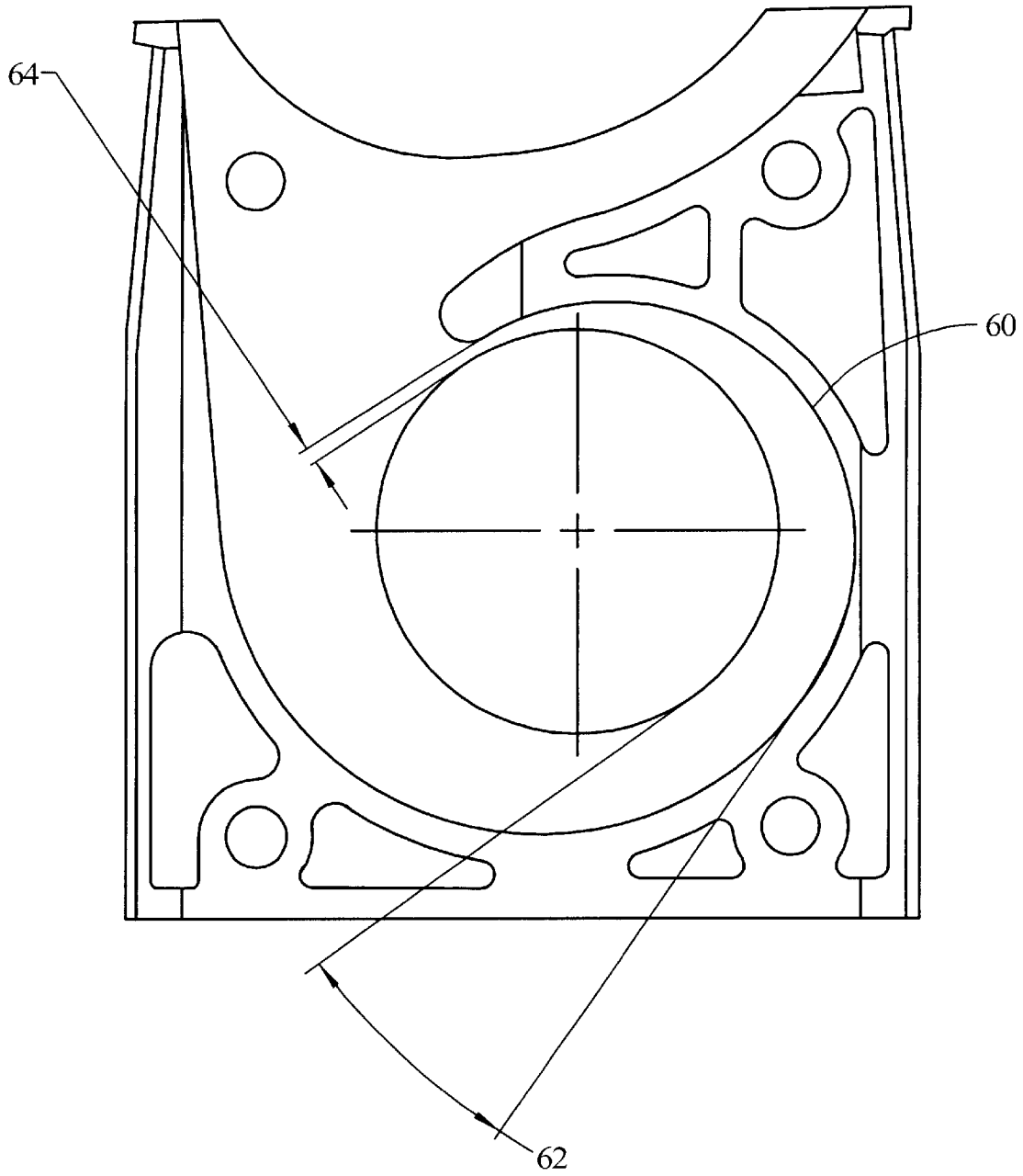
FIG. 10 is a rear view of an airflow guide in the rear of the device of FIG. 1.

Referring to FIG. 10, a rear view of the airflow guide 60 in the rear of the device 10 is shown. The airflow guide 60 has a scroll angle 62 shown by arrows in FIG. 10, which is designed for improved performance of the device 10. Such improved performance includes improved energy-efficiency and reduced noise during operation of the device 10. It is recognized and anticipated that the scroll angle 62 will vary according to the particular embodiment of the present invention, and the angle will typically depend upon the dimensions of the device 10 and the dimensions of the various components of the device 10, such as the fan 26.

The apparatus also has a cutoff width 64, which is the distance between the fan 26 and the start of the airflow guide 60. Those skilled in the art will appreciate that the fan 26 cannot touch the airflow guide 60 due to the moving blades at its outer perimeter. Accordingly, there must be a separation, or a gap, between the fan 26 and the airflow guide 60 at the narrow end of the airflow guide 60. However, a gap is undesirable because the size of the gap can affect maximum airflow and noise. Therefore, the width 64 should be minimized, but without any risk of the fan 26 coming in contact with the guide 60. Accordingly, it is recognized and anticipated that the cutoff width 64 will be customized according to the particular embodiment of the present invention, and will typically depend upon the size of the airflow apparatus, the sizes of the motor 34 and the fan 26, and the tolerances thereof during operation.

The cutoff 64 is positioned at about an 11 o'clock position with respect to the fan 26 in the embodiment depicted in FIG. 10. It is recognized and anticipated that the position of the cutoff 64 can be varied in other embodiments of the present invention, and it will typically depend upon the dimensions and particular design features of the guide airflow 60 in the particular embodiment.

As is evident from the foregoing description, certain aspects of the present invention are not limited to the particular details of the examples illustrated herein, and it is therefore contemplated that other modifications and applications will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

The embodiments of the invention in which an exclusive property or privilege is claimed are defined as follows:

1. An air treatment appliance for treating surrounding air, comprising:

a body;

a spider-mount mounted to said body;

a motor mounted in cantilever fashion to said spider-mount by a plurality of mounting screws;

a fan attached to said motor operable to draw in surrounding air and cause it to flow through said appliance; and a grommet constructed of a predetermined material between said motor and said spider-mount, said grommet preventing any direct contact between said motor mounting screws and said spider-mount to dampen vibrations from said motor and said fan, wherein said grommet includes a plurality of feet, corresponding in number to the number of said motor mounting screws, said plurality of feet held together by a plurality of connection members, and each of said plurality of feet is designed to cooperatively engage with said spider-mount by insertion of a head portion of each of said plurality of feet into a corresponding hole in said spider-mount, and wherein said plurality of mounting screws are inserted through a hole in the head portion of each of said plurality of feet to mount said motor to said spider-mount.

2. An air treatment appliance for treating surrounding air, comprising:

a body;

a spider-mount mounted to said body comprising:

a plate, an opening in said plate having a curved surface to provide a smooth transition of airflow through the spider-mount during operation of said appliance;

a plurality of interconnected bars located in a plane parallel to said plate;

at least three fins supporting said interconnected bars spaced from said plate, said fins including two spaced apart interconnected leaves, and each of said leaves having only a narrow cross-sectional area exposed to airflow through said appliance;

a motor mounted in cantilever fashion to said interconnected bars; and a radial fan to cause air to flow through said appliance attached to said motor and operable to draw in surrounding air through the opening in said plate into the middle of said radial fan and to expel it radially, wherein a considerable portion of said motor is accommodated by said spider-mount and said fan to reduce the overall size of said appliance in the dimension along the axis of the fan and motor.

3. The air treatment appliance of claim 2, further comprising an airflow guide downstream from said fan for guiding airflow from said fan, said airflow guide being a radial guide for guiding airflow and expelling it from said appliance in a predetermined direction, and said radial guide having a predetermined scroll angle.

4. The air treatment appliance of claim 3, wherein said radial guide has a cutoff gap of a predetermined width between said radial fan and said radial guide.

5. An air purifying device operable to treat surrounding air, comprising:

a frame;

a spider-mount mounted to said frame and including a plurality of interconnected bars located in a plane and having a plurality of motor mounting holes, and a plurality of fins supporting said interconnected bars spaced from and parallel to said frame;

a motor mounted in cantilever fashion to said interconnected bars by a plurality of mounting screws;

a radial fan attached to said motor and operable to draw in air from the middle thereof and to expel it radially, said fan being operable to draw in surrounding air and cause it to flow through said device;

a grommet constructed of a predetermined material having a durometer designed for at least partially dampening vibrations from said motor between said motor and said spider-mount, said grommet comprising:

a plurality of feet corresponding in number to the number of said mounting screws and held together by a plurality of connection members interconnecting said plurality of feet, each foot comprising:

a head portion;

a neck portion; and a hole through said head portion and said neck portion, wherein said head portion and said neck portion of each foot are designed to cooperatively engage with a corresponding motor mounting hole in said spider-mount and said hole in each foot is designed to receive one of said motor mounting screws; and a radial airflow guide downstream from said fan for guiding airflow from said radial fan, said radial airflow guide having a predetermined scroll angle for guiding airflow and expelling it from said device in a predetermined direction and a predetermined cutoff gap between said radial fan and said radial airflow guide.

6. The air purifying device of claim 5, further comprising a filtering mechanism wherein airflow through said device flows through said filtering mechanism, said filtering mechanism comprising a pre-filter and a HEPA filter.

7. The air purifying device of claim 5, wherein each foot in said grommet cooperatively engages with a corresponding motor mounting hole in said spider-mount by inserting the head portion in the corresponding hole past said hole, whereby the neck portion sits in said corresponding motor mounting hole.

8. The air purifying device of claim 7, wherein said motor is mounted to said spider-mount by a plurality of screws on said motor inserted through said holes through said head portion and said neck portion of said feet, and said grommet preventing any direct contact between said motor and said spider-mount.

9. A device for filtering out undesirable material from surrounding air, comprising:

a body;

a spider-mount mounted to said body;

a motor mounted in cantilever fashion to said spider-mount by a plurality of mounting screws;

a grommet between said motor and said spider-mount constructed of a material for at least partially dampening vibrations from said motor and for preventing any direct contact between said motor and said spider-mount, and said grommet comprises:

a plurality of feet connected by a plurality of connection members, each foot comprising:

a mushroom head portion, said mushroom head portion having a lead-in angle;

a neck portion; and a hole through said mushroom head portion and said neck portion, wherein said mushroom head portion and said neck portion of each foot are designed to cooperatively engage with a corresponding hole in said spider-mount by inserting said lead-in angle of said mushroom head portion in the corresponding hole and pushing said mushroom head portion past said corresponding hole until said foot snaps in said corresponding hole and said neck portion sits in said corresponding hole;

wherein said motor is mounted to said spider-mount by said plurality of screws each inserted through said hole through said mushroom head portion and said neck portion in each of said feet of said grommet, and through said corresponding hole in said spider-mount;

a radial fan attached to said motor and operable to draw in air from the middle thereof and to expel it radially, said radial fan being operable to draw in surrounding air and cause it to flow through said device, wherein a considerable portion of said motor is accommodated by said spider-mount and said fan to reduce the overall size of said appliance in the dimension along the axis of the fan and motor;

a filtering mechanism wherein airflow through said device flows through said filtering mechanism; and a radial airflow guide downstream from said fan for guiding airflow downstream from said radial fan, said radial airflow guide having a predetermined scroll angle for guiding airflow and expelling it from said device in a predetermined direction and a predetermined cutoff gap between said radial fan and said radial airflow guide.

* * * * *